US006815059B2

(12) United States Patent
Slootweg et al.

(10) Patent No.: US 6,815,059 B2
(45) Date of Patent: Nov. 9, 2004

(54) ARTIFICIAL FIBRE AS WELL AS AN ARTIFICIAL LAWN FOR SPORTS FIELDS PROVIDED WITH SUCH FIBRE

(75) Inventors: Geurt Bastiaan Slootweg, Enschede (NL); Marinus Hendrikus Olde Weghuis, Oldenzaal (NL); Frederik Van Der Gaag, Nijverdal (NL); Leonardus Jacobus Johannes Wilhelmus Welzen, Urmond (NL); Christian Antoine Marie Jean-Pierre Widdershoven, Echt (NL)

(73) Assignees: Ten Cate Thiolon B.V., Re Nijverdal (NL); DEX-Plastomer V.O.F., Heerlen (NL)

( * ) Notice: Subject to any disclaimer, the term of this patent is extended or adjusted under 35 U.S.C. 154(b) by 0 days.

(21) Appl. No.: 10/330,473

(22) Filed: Dec. 30, 2002

(65) Prior Publication Data

US 2004/0001951 A1 Jan. 1, 2004

(30) Foreign Application Priority Data

Jul. 1, 2002 (EP) ..... 02077589

(51) Int. Cl.[7] ..... D01F 8/00

(52) U.S. Cl. ..... 428/364; 428/373; 428/374; 525/191

(58) Field of Search ..... 428/373, 374, 428/364; 525/191

(56) References Cited

U.S. PATENT DOCUMENTS 4,808,561 A * 2/1989 Welborn, Jr. ..... 502/104
5,266,392 A * 11/1993 Land et al. ..... 442/400
6,545,094 B2 * 4/2003 Oswald et al. ..... 525/191

FOREIGN PATENT DOCUMENTS

WO WO93/06169 4/1993

OTHER PUBLICATIONS

Patent Abstracts of Japan, vol. 1999, No. 14, Dec. 22, 1999, JP 11 241307 A (Hagiwara Kogyo KK), Sep. 7, 1999.

Patent Abstracts of Japan, vol. 1998, No. 3, Feb. 27, 1998, JP 09 291508 A (Sekisui Chem Co Ltd), Nov. 11, 1997.

Patent Abstracts of Japan, vol. 18, No. 533, Oct. 11, 1994, JP 06 184811 A (Mitsubishi Petrochem Co Ltd), Jul. 5, 1994.

* cited by examiner

*Primary Examiner*—N. Edwards
(74) *Attorney, Agent, or Firm*—Jacobson Holman PLLC

(57) ABSTRACT

The invention relates to a method for producing a foil of synthetic material composed of a first synthetic compound and a second synthetic compound, in which the first synthetic compound consists of a polymer and the second synthetic compound consists of a plastomer.

Figure 1A:
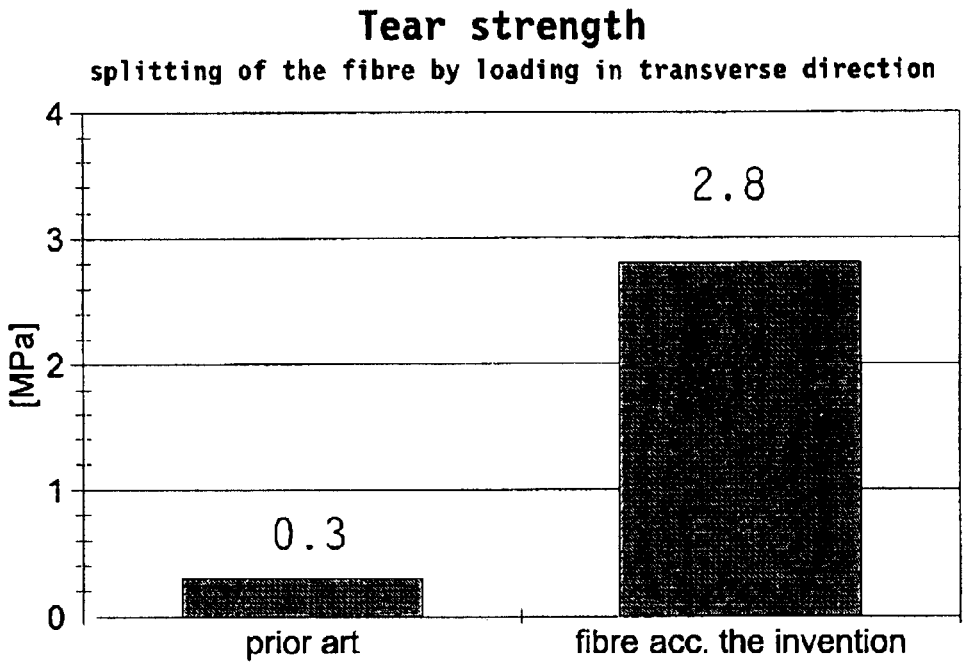

The invention also relates to a synthetic fibre and to an artificial lawn suitable for sports fields, consisting of a substrate to which synthetic fibres according to the invention are fixed.

Surprisingly, it has become apparent that when the fibres are according to the invention made from a combination of synthetic materials in which the first synthetic compound is a polymer and the second synthetic compound is a plastomer, the fibres will only exhibit a very minor any tendency to split, or even no such tendency at all, not even after stretching, also in the case of very intensive use in an artificial lawn. This renders the fibre very suitable for use in an artificial grass sports field, so that the field will not only require less maintenance but, in addition, will be capable of withstanding longer and more intensive use. Since the synthetic fibre—in addition to an improved splitting behaviour—exhibits strongly improved elastic and springing properties, the risk of injury and/or burns caused by slidings or falls is significantly reduced.

10 Claims, 2 Drawing Sheets

ARTIFICIAL FIBRE AS WELL AS AN ARTIFICIAL LAWN FOR SPORTS FIELDS PROVIDED WITH SUCH FIBRE

DESCRIPTION

The invention relates to a method for producing a foil of synthetic material composed of a first synthetic compound and a second synthetic compound, in which the first synthetic compound consists of a polymer and the second synthetic compound consists of a plastomer.

The invention also relates to a synthetic fibre and to an artificial lawn suitable for sports fields, consisting of a substrate to which synthetic fibres according to the invention are fixed.

A synthetic material having the composition according to the above introduction is generally known, in the form of a foil it is widely used as a packaging material or a roofing material. Synthetic materials are currently being used for all kinds of purposes, and significant developments in particular as regards the use of all kinds of synthetic materials in artificial lawns for sports fields have been realised the past few years.

In this connection, research has in particular been concentrated on the development of synthetic fibres for use in artificial lawns for sports fields, in which fibres of a particular length are fixed to a substrate, for example by tufting. The development of artificial grass fibres and artificial grass sports fields derived therefrom has progress so far that it is possible at present to construct artificial grass sports fields which are very difficult to distinguish from natural grass sports fields, not only as regards the way it looks but In particular as regards the way it behaves during play.

Unlike natural grass sports fields, artificial grass sports fields can be played on longer and more intensively, irrespective of the weather conditions. Currently, the development of new artificial grass fibres is in particular focussed on obtaining a fibre which will further reduce the number of injuries, such as grazes and burns when making slidings, or the incidence of twisted joints.

Existing fibres which have been specifically developed for artificial grass sports fields have this drawback, however, that they are more prone to splitting in the longitudinal direction after being stretched in that direction. Such a fibre will thus split sooner, for example as a result of being played on, which makes the fibre less suitable for use in an artificial grass sports field. The split parts of the fibre will break off sooner, as a result of which matted or otherwise bare, intensively played-on patches will form in the artificial grass sports field. This has a very negative influence on the playing properties of the artificial lawn, such as shock absorption, sliding resistance, grip and water permeability, which in turn increases the risk of injury.

It has become apparent that when the synthetic material as referred to in the introduction is in accordance with the invention extruded into a synthetic fibre, said fibre is quite suitable for use in an artificial grass sports field. The fact is that it has been established by experiment that a suitable selection of the composition or the proportion between the first synthetic compound and the second synthetic compound leads to a synthetic fibre having mechanical properties such that, due to the specific molecular structure, the fibre will split much less easily in the longitudinal direction.

This renders the fibre ideally suitable for use in an artificial grass sports field.

According to the invention, the splitting behaviour of the synthetic fibre can furthermore be significantly improved by stretching the fibre after the extrusion process. Apart form an increase in length, according to the invention the selection of materials after the stretching process gives the fibre its strength in transverse direction, as a result of which it will split less easily. When used in an artificial grass sports fields, such a fibre, and consequently the artificial lawn, will have a much longer life, the artificial lawn will require much less maintenance and will thus remain playable longer. Furthermore, the risk of injury of the players is considerably reduced.

According to the invention, the fibre may consist of at least one monofilament, in which case the fibre may be twined into a strand of several monofilaments.

On the other hand, the fibre may according to the invention be formed as a band, and more in particular as a fibrillated band fibre.

According to the invention, a fibre having a very advantageous non-splitting behaviour can be obtained in that the proportion of the plastomer in the fibre is 30–80 wt. %, and more in particular 35–50 wt. %.

The first polymer may be polypropylene or polyethylene, and in particular (linear) low-density polyethylene, high-density polyethylene, homo-polymer polypropylene or copolymer polypropylene.

Figure 1B:
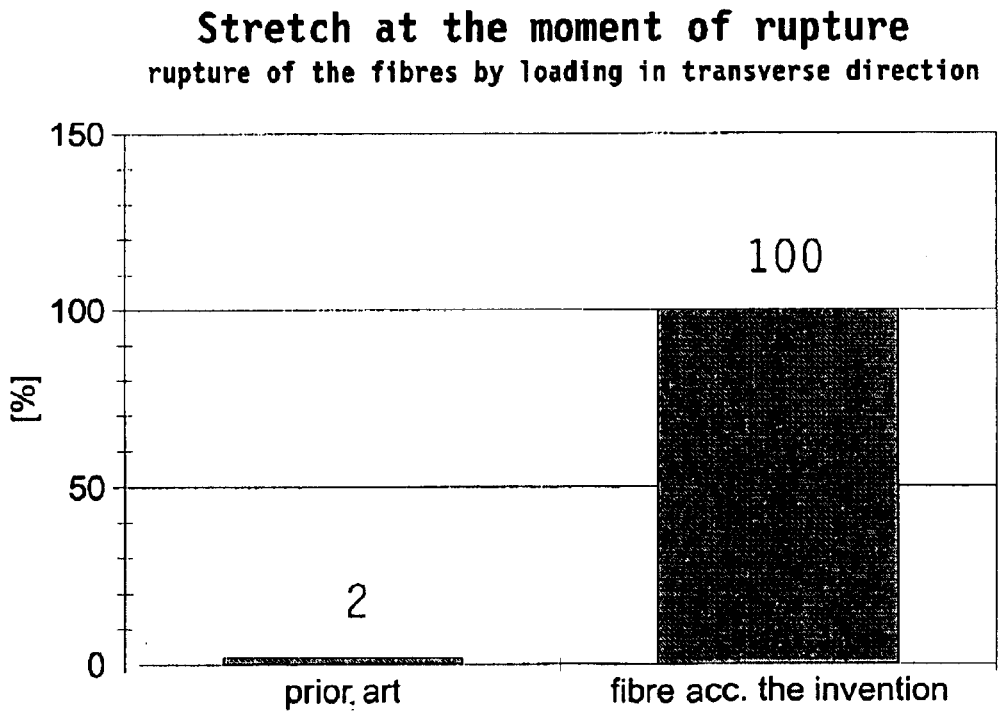
Figure 2A:
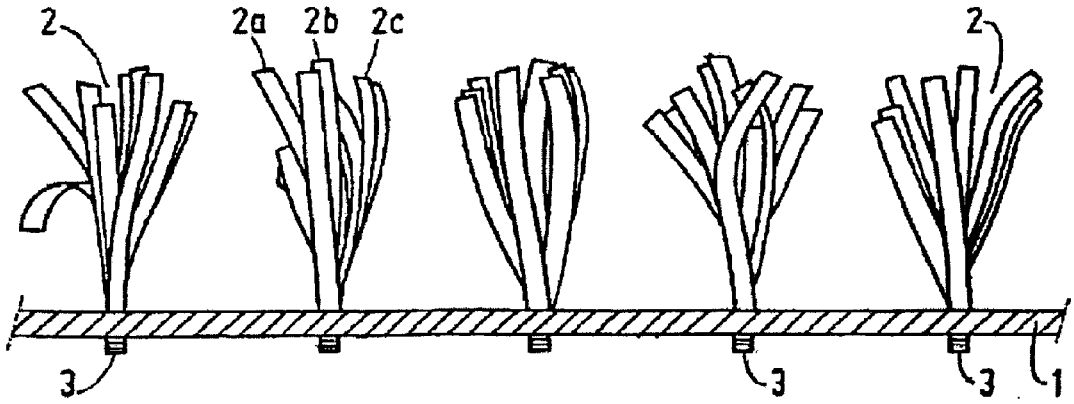
Figure 2B:
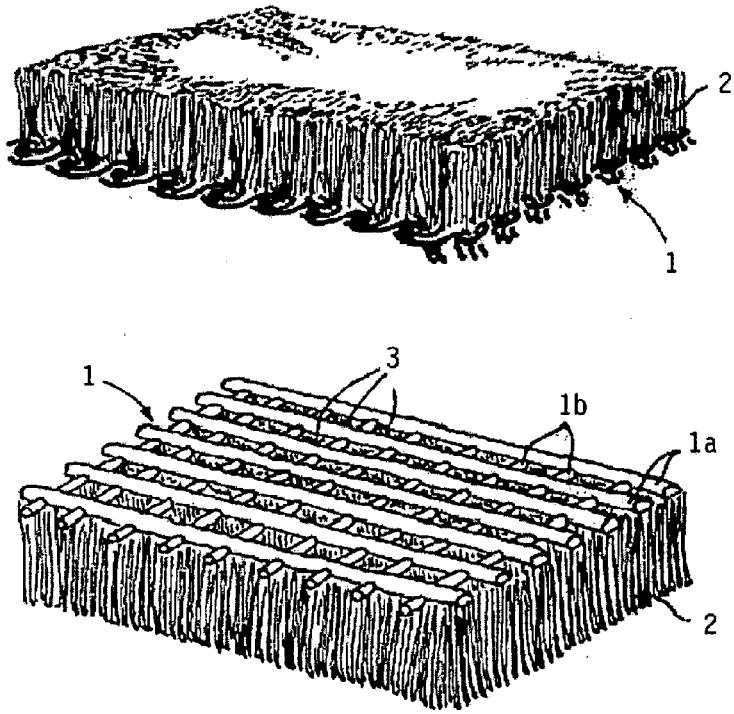

The invention will be explained in more detail hereinafter with reference to a drawing, in which:

FIGS. 1*a* and 1*b* are graphs showing specific mechanical properties transverse direction of a known fibre and a fibre according to the invention being subjected to a load in transverse direction;

FIGS. 2*a* and 2*b* schematically show a few embodiments of an artificial grass sports field provided with a synthetic fibre obtained by means of the method according to the invention.

In the case of artificial grass sports fields it is desirable for the playing properties thereof to be comparable to those of a natural grass sports field as much as possible. Consequently, the present artificial grass fibre must meet a number of requirements, inter alia as regards the rolling behaviour of the ball or other attribute of play, also in order to prevent all kinds of injuries of the players. In particular burns and grazes caused by slidings or falls should be prevented as much as possible, so that new artificial grass fibres for artificial grass sports fields are being developed in particular in order to prevent these situations.

Since an artificial grass fibre must not only exhibit a certain degree of strength, in order to prevent the fibre from lying flat, but also certain elastic or springing properties, the current artificial grass fibres are made from a synthetic material from the group of polymers.

One drawback of the use of particular polymers in an artificial grass fibre is the usually bad splitting behaviour of the fibre when the artificial grass sports field incorporating the synthetic fibre is being played on. The splitting of the synthetic fibres in the longitudinal direction, as a result of which several fibre parts are formed, has an adverse effect on the playability of the artificial grass sports field, because the fibre parts will break off more easily, as a result of which matted or bare patches are formed in the artificial grass sports field. This has a very negative effect on the playing properties (shock absorption, sliding resistance, grip, water permeability) of the sports fields, whilst in addition the risk of injury caused by slidings and the like increases significantly.

It has become apparent that the splitting behaviour of the synthetic fibres can be influenced by using a mixture or blend of polymers. It has been established by experiment that in certain situations, when a synthetic material composed of a first synthetic compound and a second synthetic compound, in which the first synthetic compound consists of a polymer and the second synthetic compound consists of a plastomer, is extruded into a fibre, the fibre that is obtained has advantageous mechanical properties, and in particular an advantageous splitting behaviour, which make the fibre quite suitable for use in artificial grass sports fields.

The mechanical properties of the synthetic fibre thus obtained are to a significant degree determined by the molecular structure of the two synthetic compounds in the mixture. When the two synthetic compounds are mixed and the mixture is extruded into an elongated fibre, a number of different effects on the level of the molecular structure may occur in the final product.

According to the invention, a fibre which is very suitable for use in an artificial grass sports field is obtained by selecting, in accordance with the invention, a polyethylene or polypropylene for one of the two synthetic compounds and a plastomer for the other synthetic compound and extruding said blend into a synthetic fibre. The fact is that it has been established by experiment that a suitable selection of the composition or the proportion between the first synthetic compound and the second synthetic compound will result in a synthetic fibre having mechanical properties such that, due to its specific molecular structure, the fibre will inter alia split much less easily in its longitudinal direction.

This renders the fibre ideally suitable for use in an artificial grass sports field.

Preferably, the first synthetic compound is polypropylene or polyethylene. It has become apparent that (linear) low-density polyethylene or high-density polyethylene are also suitable for use as the first synthetic compound. It is also possible to use homo-polymer polypropylene or copolymer polypropylene as the first synthetic compound.

The plastomers (second synthetic compound) used in the synthetic fibre according to the invention that are mentioned herein are thermoplastic homopolymers of ethene and copoloymers of ethene, with one or more $\alpha$-olefins having 3–10 C-atoms, in particular propene, isobutene, 1-butene, 1-hexene, 4-methyl-1-pentene and 1-octene as the comonomer, which are to be prepared by means of metallocene catalysts and other single-site catalysts. As a rule, the proportion of comonomer ranges between 0 and 50 wt. %, preferably between 5 and 35 wt. %. The density usually ranges between 860 and 970 kg/m$^3$. The plastomers are different from the polyethenes, which have been prepared by means of Ziegler-Natta catalysts, for example, in that they have a narrow molecular weight distribution Mw/Mn, with values which usually range between 1.5 and 3, and a limited degree of long chain branching. As a rule, the number of long chains amounts to maximally 3 per 1000 C-atoms. Suitable plastomers are produced on a commercial scale, for example by Exxon and DEX-Plastomers under the brand name Exact®, and by Dow, inter alia under the brand names Engage®, Affinity®, Exceed®.

A suitable fibre according to the invention can be obtained by selecting a suitable mixing ratio between the two synthetic compounds, in which the weight percentage of the plastomer is 30–80%.

In particular synthetic fibres containing plastomer in a weight percentage of 30–50% appear to have strongly improved mechanical properties, and more in particular exhibit a very advantageous non-splitting behaviour.

It is known that the stretching of synthetic fibres or bands in their longitudinal direction makes said fibres or bands more prone to splitting in that direction. Also the known materials used for artificial grass fibres exhibit an undesirable tendency to split. Surprisingly, it has become apparent that the fibres made from/consisting of the combination of materials according to the invention, the fibres will only exhibit a very minor any tendency to split, or even no such tendency at all, not even after stretching, also in the case of very intensive use in an artificial lawn. This renders the fibre very suitable for use in an artificial grass sports field, so that the field will not only require less maintenance but, in addition, will be capable of withstanding longer and more intensive use. Since the synthetic fibre—in addition to an improved splitting behaviour—exhibits strongly improved elastic and springing properties, the risk of injury and/or burns caused by slidings or falls is significantly reduced.

FIGS. 1*a* and 1*b* show graphs in which the mechanical properties of an unknown synthetic fibre and the fibre obtained by means of the method according to the invention are marked off against each other. FIG. 1*a* shows the splitting properties of the two fibres obtained by loading the fibres in transverse direction and thus determining the tear strength in MPa. The figure clearly shows that the fibre according to the invention has a higher tear resistance and will split less easily, therefore. FIG. 1*b* shows the maximum stretch of the two fibres at the moment of rupture of the two fibres upon being loaded in transverse direction. The figure clearly shows that the fibre according to the invention not only splits less easily (FIG. 1*a*), but in addition is much stronger (FIG. 1*b*) and consequently can be used very well in an artificial grass sports fields.

It has become apparent that in comparison with the synthetic fibres that have been used in artificial grass sports fields so far, which fibres exhibited a stretch factor of 2%–5% (as shown in FIG. 1*b*) upon being loaded in transverse direction, the fibre according to the invention exhibits a stretch factor of 100% (as shown in FIG. 1*b*) before rupturing upon being loaded in transverse direction. Tests have shown that when a suitable mixing proportion of the first synthetic compound (the polymer) and the second synthetic compound (the plastomer) is used, the synthetic fibre according to the invention that is thus obtained will exhibit a stretch factor of up to 700% before rupturing upon being loaded in transverse direction.

FIGS. 2*a* and 2*b* show a few embodiments of an artificial grass sports field, in which a synthetic fibre according to the invention can be used. In both figures, the artificial grass sports field comprises a substrate 1, to which several synthetic fibres 2 obtained by using the method according to the invention have been fixed at the location indicated by numeral 3, for example by tufting. The synthetic fibre 2 may have been extruded in the form of a band and be fixed to the substrate separately or as a bundle of fibres 2*a*–2*b* which have been twined together, for example. More in particular, the fibre that has been extruded in the form of a band may be a fibrillated band fibre.

In another embodiment, as shown in FIG. 2*b*,the synthetic fibre according to the invention may be a monofilament. Also in this embodiment, several monofilaments may be combined into a bundle by twining, after which each bundle is fixed to the substrate 1. In FIG. 2*b*, the substrate has an open structure consisting of a grid of supporting yarns 1*a*–1*b*, to which the synthetic fibres 2 are fixed.

What is claimed is:

1. A synthetic fibre comprising a mixture of a first synthetic compound and a second synthetic compound, wherein said first synthetic compound is a polymer, said second synthetic compound is a plastomer, and the proportion of the plastomer in the fibre is 30–80 wt. %.

2. The synthetic fibre according to claim 1, wherein the proportion of the plastomer in the fibre is 35–50 wt. %.

3. The synthetic fibre according to claim 1, wherein the polymer is polypropylene or polyethylene, and in particular low-density polyethylene, high-density polyethylene, homopolymer polypropylene or copolymer polypropylene.

4. The synthetic fibre according to claim 1, wherein said plastomer is a copolymer of ethene, with one or more α-olefins having 3–10 C-atoms, in particular propene, isobutene, 1-butene, 1-hexene, 4-methyl-1-pentene and 1-octene as the comonomer.

5. The synthetic fibre according to claim 4, wherein the proportion of comonomer ranges between 0 and 50 wt. %.

6. The synthetic fibre according to claim 4, wherein the density of the plastomer ranges between 860 and 970 $kg/m^3$.

7. The synthetic fibre according to claim 1, wherein the polymer is polyethylene.

8. The synthetic fibre according to claim 1, wherein the plastomer is a copolymer of ethene, with 1-octene as the comonomer.

9. The synthetic fibre according to claim 4, wherein the proportion of comonomer ranges between 5 and 35 wt. %.

10. The synthetic fibre according to claim 1, wherein said fibre is an extruded fibre.

* * * * *